US007415852B1

(12) United States Patent
Merrem

(10) Patent No.: US 7,415,852 B1
(45) Date of Patent: Aug. 26, 2008

(54) TUBULAR LOCK WITH THEFT DETERRENT

(75) Inventor: Ralph Merrem, San Francisco, CA (US)

(73) Assignee: ACCO Brands USA LLC, Lincolnshire, IL (US)

( * ) Notice: Subject to any disclaimer, the term of this patent is extended or adjusted under 35 U.S.C. 154(b) by 289 days.

(21) Appl. No.: 11/245,274

(22) Filed: Oct. 5, 2005

Related U.S. Application Data

(60) Provisional application No. 60/616,799, filed on Oct. 6, 2004.

(51) Int. Cl.
*E05B 69/00* (2006.01)
*E05B 15/00* (2006.01)
*E05B 27/00* (2006.01)

(52) U.S. Cl. ..... 70/58; 70/419; 70/491

(58) Field of Classification Search ..... 70/58, 70/378, 491, 419–421
See application file for complete search history.

(56) References Cited

U.S. PATENT DOCUMENTS

| | | | |
|---|---|---|---|
| 87,045 | A | 2/1869 | Holmes |
| 285,074 | A | 9/1883 | Rhoades et al. |
| 505,299 | A | 9/1893 | Schneider |
| 606,734 | A | 7/1898 | Olmstead |
| 611,646 | A | 10/1898 | Parker |
| 786,842 | A | 4/1905 | Robeson |
| 881,364 | A | 3/1908 | Wheeler |
| 934,928 | A | 9/1909 | Michel |
| 942,537 | A | 12/1909 | Batdorf |
| 952,411 | A | 3/1910 | Billy |
| 1,004,333 | A | 9/1911 | Alsterberg |
| 1,050,276 | A | 1/1913 | Johnson |
| 1,101,450 | A | 6/1914 | Kerry |
| 1,432,546 | A | 10/1922 | Gillom |
| 1,452,471 | A | 4/1923 | Kline |
| 1,470,937 | A | 10/1923 | Schou |
| 1,534,936 | A | 4/1925 | Fishchbach |
| 1,672,333 | A | 6/1928 | Miller |
| 1,786,511 | A | 12/1930 | Warren |
| 2,001,354 | A | 5/1935 | Smith |
| 2,102,583 | A | 12/1937 | Alberg |
| 2,109,109 | A | 2/1938 | Finch |
| 2,130,216 | A | 9/1938 | Zaninovich |

(Continued)

FOREIGN PATENT DOCUMENTS

| | | |
|---|---|---|
| CA | 454901 | 3/1949 |

(Continued)

OTHER PUBLICATIONS

U.S. Appl. No. 90/007,221, Murray, Jr et al.

(Continued)

*Primary Examiner*—Suzanne Dino Barrett
(74) *Attorney, Agent, or Firm*—Townsend and Townsend and Crew LLP

(57) ABSTRACT

A tubular lock is disclosed. The tubular lock includes an outer portion, and an inner portion. A plurality of movable driver pins is disposed between the outer portion and the inner portion. The pins are accessible through a space formed by the outer portion and the inner portion. At least one fixed structure prevents an unauthorized tubular lock picking structure from entering the space.

22 Claims, 5 Drawing Sheets

U.S. PATENT DOCUMENTS

| | | | | | |
|---|---|---|---|---|---|
| 2,172,208 | A | | 9/1939 | Kutrzon | |
| 2,190,661 | A | | 2/1940 | Hauer | |
| 2,383,397 | A | | 8/1945 | Lofquist | |
| 2,405,400 | A | | 8/1946 | Butterfiled | |
| 2,435,876 | A | | 2/1948 | De Swart | |
| 2,469,874 | A | | 5/1949 | Fetsko, Jr. | |
| 2,480,662 | A | | 8/1949 | McKinzie | |
| 2,530,560 | A | | 11/1950 | Young | |
| 2,577,956 | A | | 12/1951 | Elsberg | |
| 2,594,012 | A | | 4/1952 | Griffin | |
| 2,660,084 | A | | 11/1953 | Newman | |
| 2,677,261 | A | | 5/1954 | Jacobi | |
| 2,729,418 | A | | 1/1956 | Maynard | |
| 2,800,090 | A | | 7/1957 | Reid | |
| 2,963,310 | A | | 12/1960 | Abolins | |
| 3,091,011 | A | | 5/1963 | Campbell | |
| 3,101,695 | A | | 8/1963 | Honeyman, Jr. | |
| 3,130,571 | A | | 4/1964 | Neumann | |
| 3,136,017 | A | | 6/1964 | Preziosi | |
| 3,171,182 | A | | 3/1965 | Danehy | |
| 3,174,384 | A | | 3/1965 | Vanni | |
| 3,200,694 | A | | 8/1965 | Rapata | |
| 3,211,408 | A | | 10/1965 | Schaefer | |
| 3,213,745 | A | | 10/1965 | Dwyer | |
| 3,220,077 | A | | 11/1965 | Newcomer, Jr. et al. | |
| 3,267,707 | A | * | 8/1966 | Adams | 70/419 |
| 3,276,835 | A | | 10/1966 | Hall | |
| 3,469,874 | A | | 9/1969 | Mercurio | |
| 3,486,158 | A | | 12/1969 | Soltysik et al. | |
| 3,521,845 | A | | 7/1970 | Sweda et al. | |
| 3,541,819 | A | * | 11/1970 | Kerr | 70/491 |
| 3,590,608 | A | | 7/1971 | Smyth et al. | |
| 3,625,031 | A | | 12/1971 | Alley, III | |
| 3,634,963 | A | | 1/1972 | Hermann | |
| 3,664,163 | A | | 5/1972 | Foote | |
| 3,722,239 | A | | 3/1973 | Mestre | |
| 3,727,934 | A | | 4/1973 | Averbook et al. | |
| 3,737,135 | A | | 6/1973 | Bertolini | |
| 3,754,420 | A | | 8/1973 | Oellerich | |
| 3,765,197 | A | | 10/1973 | Foote | |
| 3,771,338 | A | | 11/1973 | Raskin | |
| 3,772,645 | A | | 11/1973 | Odenz et al. | |
| 3,782,146 | A | | 1/1974 | Franke | |
| 3,785,183 | A | | 1/1974 | Sander | |
| 3,798,934 | A | | 3/1974 | Wright et al. | |
| 3,813,906 | A | * | 6/1974 | Kerr | 70/491 |
| 3,817,066 | A | * | 6/1974 | Pearson | 70/491 |
| 3,826,510 | A | | 7/1974 | Halter | |
| D232,416 | S | | 8/1974 | Gazda et al. | |
| 3,836,704 | A | | 9/1974 | Coules | |
| 3,859,826 | A | | 1/1975 | Singer et al. | |
| 3,866,873 | A | | 2/1975 | Bohli | |
| 3,875,645 | A | | 4/1975 | Tucker et al. | |
| 3,905,570 | A | | 9/1975 | Nieuwveld | |
| 3,910,079 | A | | 10/1975 | Gassaway | |
| 3,910,081 | A | | 10/1975 | Pender | |
| 3,939,752 | A | | 2/1976 | Koscik | |
| 3,986,780 | A | | 10/1976 | Nivet | |
| 3,990,276 | A | | 11/1976 | Shontz | |
| 3,999,410 | A | | 12/1976 | Hall | |
| 4,003,228 | A | | 1/1977 | Lievens et al. | |
| 4,004,440 | A | | 1/1977 | Dreyer | |
| 4,006,615 | A | * | 2/1977 | Szova | 70/491 |
| 4,007,613 | A | | 2/1977 | Gassaway | |
| 4,018,339 | A | | 4/1977 | Pritz | |
| 4,028,913 | A | | 6/1977 | Falk | |
| 4,028,916 | A | | 6/1977 | Pender | |
| 4,041,739 | A | * | 8/1977 | Mercurio | 70/491 |
| 4,047,748 | A | | 9/1977 | Whaley et al. | |
| 4,055,973 | A | | 11/1977 | Best | |
| 4,057,984 | A | | 11/1977 | Avaiusini | |
| 4,065,083 | A | | 12/1977 | Gassaway | |
| 4,066,195 | A | | 1/1978 | Dickler | |
| 4,066,231 | A | | 1/1978 | Bahner | |
| 4,104,951 | A | | 8/1978 | Leitner | |
| 4,111,020 | A | * | 9/1978 | Scherbing | 70/491 |
| 4,112,820 | A | * | 9/1978 | Conger et al. | 70/491 |
| 4,114,409 | A | | 9/1978 | Scire | |
| 4,118,902 | A | | 10/1978 | Saxton | |
| 4,123,922 | A | | 11/1978 | Kuenstler | |
| 4,131,001 | A | | 12/1978 | Gotto | |
| 4,212,175 | A | | 7/1980 | Zakow | |
| 4,223,542 | A | | 9/1980 | Basseches | |
| 4,252,007 | A | | 2/1981 | Kerley | |
| 4,263,833 | A | | 4/1981 | Loudin et al. | |
| 4,300,371 | A | | 11/1981 | Herwick et al. | |
| 4,311,883 | A | | 1/1982 | Kidney | |
| 4,337,462 | A | | 6/1982 | Lemelson | |
| 4,391,110 | A | | 7/1983 | Nielson | |
| 4,394,101 | A | | 7/1983 | Richer | |
| 4,418,550 | A | | 12/1983 | Hamilton | |
| 4,419,034 | A | | 12/1983 | DiMartino | |
| 4,442,571 | A | | 4/1984 | Davis et al. | |
| 4,448,049 | A | | 5/1984 | Murray | |
| 4,462,233 | A | | 7/1984 | Horetzke | |
| 4,466,259 | A | | 8/1984 | Osgood, Sr. | |
| 4,471,980 | A | | 9/1984 | Hickman | |
| 4,478,545 | A | | 10/1984 | Mizusawa et al. | |
| 4,501,460 | A | | 2/1985 | Sisler | |
| 4,507,945 | A | * | 4/1985 | Hwang | 70/491 |
| 4,527,405 | A | | 7/1985 | Renick et al. | |
| 4,546,629 | A | * | 10/1985 | Hwang | 70/491 |
| 4,570,465 | A | | 2/1986 | Bennett | |
| 4,579,492 | A | | 4/1986 | Kazino et al. | |
| 4,584,856 | A | | 4/1986 | Petersdorff et al. | |
| 4,586,843 | A | | 5/1986 | Henge et al. | |
| 4,593,273 | A | | 6/1986 | Narcisse | |
| 4,598,272 | A | | 7/1986 | Cox | |
| 4,603,829 | A | | 8/1986 | Koike et al. | |
| 4,610,587 | A | | 9/1986 | Wollar | |
| 4,616,490 | A | | 10/1986 | Robbins | |
| 4,640,106 | A | | 2/1987 | Derman | |
| 4,653,297 | A | * | 3/1987 | Moorhouse | 70/491 |
| 4,655,057 | A | | 4/1987 | Derman | |
| 4,656,848 | A | | 4/1987 | Rose | |
| 4,667,491 | A | | 5/1987 | Lokken et al. | |
| 4,676,080 | A | | 6/1987 | Schwarz | |
| 4,680,949 | A | | 7/1987 | Stewart | |
| 4,685,312 | A | | 8/1987 | Lakoski et al. | |
| 4,691,891 | A | | 9/1987 | Dionne | |
| 4,692,968 | A | | 9/1987 | Girard | |
| 4,704,881 | A | | 11/1987 | Sloop, Sr. | |
| 4,733,840 | A | | 3/1988 | D'Amore | |
| 4,738,428 | A | | 4/1988 | Themistos et al. | |
| 4,741,185 | A | | 5/1988 | Weinert et al. | |
| 4,768,361 | A | | 9/1988 | Derman | |
| 4,770,583 | A | | 9/1988 | Lindberg | |
| 4,779,434 | A | | 10/1988 | Derman | |
| 4,785,291 | A | | 11/1988 | Hawthorne | |
| 4,801,232 | A | | 1/1989 | Hempel | |
| 4,804,943 | A | | 2/1989 | Soleimani | |
| 4,805,426 | A | | 2/1989 | Dimmick et al. | |
| 4,813,252 | A | | 3/1989 | Ray | |
| 4,826,193 | A | | 5/1989 | Davis | |
| 4,834,600 | A | | 5/1989 | Lemke | |
| 4,842,912 | A | | 6/1989 | Hutter, III | |
| 4,843,848 | A | | 7/1989 | Igelmund | |
| 4,856,304 | A | | 8/1989 | Derman | |
| 4,856,305 | A | | 8/1989 | Adams | |
| 4,858,455 | A | | 8/1989 | Kuo | |
| 4,862,716 | A | | 9/1989 | Derman | |
| 4,870,840 | A | | 10/1989 | Klein | |
| 4,893,488 | A | | 1/1990 | Klein | |
| 4,907,111 | A | | 3/1990 | Derman | |

| | | | | |
|---|---|---|---|---|
| 4,907,716 | A | 3/1990 | Wankel et al. | |
| 4,918,952 | A | 4/1990 | Lakoski et al. | |
| 4,924,683 | A | 5/1990 | Derman | |
| 4,924,693 | A | 5/1990 | College et al. | |
| 4,938,040 | A | 7/1990 | Humphreys, Jr. | |
| 4,959,635 | A | 9/1990 | Wilson | |
| 4,959,979 | A | 10/1990 | Filipow et al. | |
| 4,964,285 | A | 10/1990 | Lakoski | |
| 4,966,511 | A | 10/1990 | Lee | |
| 4,978,265 | A | 12/1990 | DeWan | |
| 4,979,382 | A | 12/1990 | Perry | |
| 4,985,695 | A | 1/1991 | Wilkinson et al. | |
| 4,986,097 | A | 1/1991 | Derman | |
| 4,993,244 | A | 2/1991 | Osman | |
| 5,001,460 | A | 3/1991 | Basson | |
| 5,001,854 | A | 3/1991 | Derman | |
| 5,010,748 | A | 4/1991 | Derman | |
| 5,020,349 | A * | 6/1991 | Lee | 70/491 |
| 5,022,242 | A | 6/1991 | Povilaitis | |
| 5,024,072 | A * | 6/1991 | Lee | 70/491 |
| 5,027,627 | A | 7/1991 | Derman | |
| 5,050,836 | A | 9/1991 | Makous | |
| 5,052,199 | A | 10/1991 | Derman | |
| 5,063,763 | A | 11/1991 | Johnson | |
| 5,067,151 | A | 11/1991 | Inagaki | |
| 5,076,079 | A | 12/1991 | Monoson | |
| 5,082,232 | A | 1/1992 | Wilson | |
| 5,082,233 | A | 1/1992 | Ayers et al. | |
| 5,099,663 | A | 3/1992 | Dearstine | |
| 5,117,661 | A | 6/1992 | Carl et al. | |
| 5,119,649 | A | 6/1992 | Spence | |
| 5,135,197 | A | 8/1992 | Kelley et al. | |
| 5,138,785 | A | 8/1992 | Paterson | |
| 5,146,769 | A | 9/1992 | Smith | |
| 5,154,456 | A | 10/1992 | Moore | |
| 5,184,798 | A | 2/1993 | Wilson | |
| 5,197,706 | A | 3/1993 | Braithwaite et al. | |
| 5,223,815 | A | 6/1993 | Rosenthal et al. | |
| D337,040 | S | 7/1993 | Carl | |
| 5,228,319 | A | 7/1993 | Holley et al. | |
| 5,279,136 | A | 1/1994 | Perry | |
| 5,317,304 | A | 5/1994 | Choi | |
| 5,327,752 | A * | 7/1994 | Myers et al. | 70/58 |
| D350,473 | S | 9/1994 | Simon | |
| 5,349,834 | A | 9/1994 | Davidge | |
| 5,351,507 | A | 10/1994 | Derman | |
| 5,351,508 | A | 10/1994 | Kelley | |
| 5,361,610 | A | 11/1994 | Sanders | |
| 5,370,488 | A | 12/1994 | Sykes | |
| 5,377,512 | A | 1/1995 | Kelley | |
| 5,381,685 | A | 1/1995 | Carl et al. | |
| 5,390,514 | A | 2/1995 | Harmon | |
| 5,390,977 | A | 2/1995 | Miller | |
| 5,394,713 | A | 3/1995 | Harmon | |
| 5,397,171 | A | 3/1995 | Leach | |
| 5,398,530 | A | 3/1995 | Derman | |
| 5,400,622 | A | 3/1995 | Harmon | |
| 5,402,662 | A * | 4/1995 | Osada | 70/491 |
| 5,406,809 | A | 4/1995 | Igelmund | |
| 5,412,959 | A | 5/1995 | Bentley | |
| 5,421,667 | A | 6/1995 | Leyden et al. | |
| 5,447,049 | A | 9/1995 | Shien | |
| 5,466,022 | A | 11/1995 | Derman | |
| 5,489,173 | A | 2/1996 | Hofle | |
| 5,493,878 | A | 2/1996 | Murray et al. | |
| 5,502,989 | A | 4/1996 | Murray, Jr. et al. | |
| 5,520,031 | A | 5/1996 | Davidge | |
| D370,473 | S | 6/1996 | Derman | |
| 5,544,512 | A * | 8/1996 | Shieh | 70/491 |
| 5,548,981 | A | 8/1996 | Kirk | |
| 5,579,657 | A | 12/1996 | Makous | |
| 5,593,878 | A | 1/1997 | Knopf et al. | |
| 5,603,416 | A | 2/1997 | Richardson et al. | |
| 5,608,605 | A | 3/1997 | Siow et al. | |
| 5,611,223 | A | 3/1997 | Spitzer | |
| 5,622,064 | A * | 4/1997 | Gluskoter et al. | 70/14 |
| 5,687,592 | A | 11/1997 | Penniman | |
| 5,692,400 | A | 12/1997 | Bliven et al. | |
| 5,709,110 | A | 1/1998 | Greenfield et al. | |
| 5,722,268 | A | 3/1998 | Choi | |
| 5,787,739 | A | 8/1998 | Derman | |
| 5,791,171 | A * | 8/1998 | Kelley | 70/58 |
| 5,799,520 | A | 9/1998 | Laabs et al. | |
| 5,836,183 | A | 11/1998 | Derman | |
| 5,870,281 | A | 2/1999 | Kim | |
| 5,875,657 | A * | 3/1999 | Kelley | 70/18 |
| 5,913,907 | A | 6/1999 | Lee | |
| 5,963,131 | A | 10/1999 | D'Angelo et al. | |
| 5,983,679 | A | 11/1999 | Reyes | |
| 6,000,251 | A | 12/1999 | Murray et al. | |
| 6,000,252 | A | 12/1999 | Murray et al. | |
| 6,006,557 | A | 12/1999 | Carl et al. | |
| 6,038,891 | A | 3/2000 | Zeren et al. | |
| 6,058,744 | A | 5/2000 | Ling | |
| 6,081,974 | A | 7/2000 | McDaid | |
| 6,112,561 | A | 9/2000 | Carl | |
| 6,112,562 | A | 9/2000 | Murray, Jr. et al. | |
| 6,133,830 | A | 10/2000 | D'Angelo et al. | |
| 6,155,088 | A | 12/2000 | Murray, Jr. et al. | |
| 6,170,364 | B1 | 1/2001 | Johnson | |
| 6,173,591 | B1 | 1/2001 | Derman | |
| 6,199,413 | B1 | 3/2001 | McDaid et al. | |
| 6,205,824 | B1 | 3/2001 | Miao | |
| 6,212,918 | B1 | 4/2001 | Kravtin | |
| 6,227,017 | B1 | 5/2001 | Igelmund | |
| 6,244,080 | B1 | 6/2001 | Sakurai | |
| 6,244,082 | B1 | 6/2001 | Avganim | |
| 6,257,029 | B1 | 7/2001 | Liao | |
| 6,265,974 | B1 | 7/2001 | D'Angelo et al. | |
| 6,301,940 | B1 | 10/2001 | Derman et al. | |
| 6,317,936 | B1 | 11/2001 | McDaid et al. | |
| 6,360,405 | B1 | 3/2002 | McDaid et al. | |
| 6,401,502 | B1 | 6/2002 | Yang | |
| 6,449,992 | B1 | 9/2002 | Yu et al. | |
| 6,513,350 | B1 | 2/2003 | Hurd et al. | |
| 6,553,794 | B1 | 4/2003 | Murray, Jr. et al. | |
| 6,588,241 | B1 | 7/2003 | Murray, Jr. et al. | |
| 6,591,642 | B1 | 7/2003 | Kuo | |
| 6,619,080 | B1 | 9/2003 | Yu | |
| 6,619,081 | B1 | 9/2003 | Yu | |
| 6,718,808 | B2 * | 4/2004 | Yu | 70/491 |
| 6,735,990 | B1 | 5/2004 | Murray, Jr. et al. | |
| 6,758,069 | B2 | 7/2004 | Derman | |
| 6,886,376 | B2 | 5/2005 | Kuo | |
| 7,007,522 | B1 * | 3/2006 | Lee | 70/43 |
| 7,150,168 | B1 * | 12/2006 | Kuo | 70/491 |
| 7,234,330 | B2 * | 6/2007 | Tseng | 70/491 |
| 2003/0101778 | A1 | 6/2003 | Carl et al. | |
| 2004/0040350 | A1 | 3/2004 | Derman | |
| 2004/0206138 | A1 | 10/2004 | Murray et al. | |
| 2005/0150262 | A1 | 7/2005 | Murray et al. | |
| 2005/0150263 | A1 | 7/2005 | Murray et al. | |
| 2005/0178173 | A1 | 8/2005 | Kuo | |

FOREIGN PATENT DOCUMENTS

| | | |
|---|---|---|
| CA | 791364 | 8/1968 |
| CA | 987121 | 4/1976 |
| DE | 329934 | 12/1920 |
| DE | 335741 | 4/1921 |
| DE | 361068 | 4/1923 |
| DE | 456219 | 2/1928 |
| DE | 577757 | 8/1932 |
| DE | 3202700 | 8/1983 |
| DE | 3824393 | 7/1989 |
| FR | 455740 | 8/1913 |

| | | | |
|---|---|---|---|
| FR | 877220 | | 12/1942 |
| FR | 1026519 | | 4/1953 |
| FR | 1085107 | | 1/1955 |
| FR | 2308006 | | 11/1976 |
| FR | 2636686 | A1 | 3/1990 |
| GB | 447091 | | 5/1936 |
| GB | 1256295 | | 12/1971 |
| GB | 1376011 | | 12/1974 |
| GB | 2109109 | A | 5/1983 |
| GB | 2234856 | A | 2/1991 |
| IT | 451949 | | 10/1949 |
| JP | 37-7592 | | 11/1972 |
| JP | 49-91096 | | 8/1974 |
| JP | 52-36813 | | 3/1977 |
| JP | 57-25092 | | 2/1982 |
| JP | 57-179618 | | 11/1982 |
| JP | 2000-140948 | | 5/2000 |
| NO | 14095 | | 5/1905 |
| WO | WO 95/10680 | | 4/1985 |
| WO | WO 86/00396 | | 1/1986 |
| WO | WO 93/15295 | | 8/1993 |
| WO | WO 96/07002 | A1 | 3/1996 |

OTHER PUBLICATIONS

U.S. Appl. No. 90/007,225, Carl et al.
U.S. Appl. No. 90/007,674, Myers et al.
U.S. Appl. No. 95/000,116, Murray, Jr. et al.
U.S. Appl. No. 09/441,142, Murray et al.
U.S. Appl. No. 09/603,240, Murray et al.
U.S. Appl. No. 09/804,973, Murray et al.
U.S. Appl. No. 10/970,060, Merrem et al.
U.S. Appl. No. 11/000,397, Merrem et al.
Kablit Security System Catalog, pp. 7, 93, 1988. Computer and Office Equipment Security Catalog, 1990, Secure-It, Inc., 18 Maple Court, East Longmeadow, MA 01028.
Kensington Product Brochure for Kensington Apple Laser Writer and Macintosh Portable Security Systems, Computer and Office Equipment Security Catalog, 1990, Secure-It, Inc., 18 Maple Court, East Longmeadow, MA 01028.
Apple Security Bracket sold in AS kit.
Retaining Device Incorporated in Apple Computers.
Kensington MicroSaver Computer Lock Box and Literature, 3 pages.
Kensington Product News Release; "Kensington Wins Case Protecting Cable Lock Status", 2003, 1 page.
*ACCO Brands, Inc.* v. *Micro Security Devices, Inc.* Federal Circuit Court Order Granting Defendant's Motion for Summary Judgment, Jul. 23, 2002, 13 pages.
Maltoni, D. et al.; "Handbook of Fingerprint Recognition"; Chapter 1: Introduction, 2003, Springer, New York, pp. 1-52.
Passproof User Manual 1990, 5 pages.
Flexguard Security System, Philadelphia Security Products (no date on page) (1 page).
Los Angeles Times, Jan. 12, 1989, Part V, p. 10.
Kensington Microsaver Packaging and Manual (copyright 1992), 4 pages.

* cited by examiner

TUBULAR LOCK WITH THEFT DETERRENT

CROSS-REFERENCE TO RELATED APPLICATIONS

This patent application is a non-provisional of and claims the benefit of the filing date of U.S. Provisional Application No. 60/616,799, filed on Oct. 6, 2004, which is herein incorporated by reference in its entirety for all purposes.

BACKGROUND OF THE INVENTION

Recent news reports indicate that the plastic barrel of a certain type of pen can be used to open a certain type of tubular lock that is present on bicycle locks. According to the news reports, the plastic barrel can be inserted into the keyway of the tubular lock, and after some effort, the lock can be opened. The insertion of the plastic barrel into the keyway of a tubular lock can mold the plastic barrel to the shape of a key, and the molded barrel could be potentially used to turn the lock.

Improvements to deter this type of lock picking would be desirable.

BRIEF SUMMARY OF THE INVENTION

Embodiments of the invention are directed to tubular locks and methods of use thereof.

One embodiment of the invention is directed to a tubular lock comprising: an outer portion; an inner portion; and a plurality of movable pins disposed between the outer portion and the inner portion, and being accessible through a space formed by the outer portion and the inner portion; and at least one fixed structure inhibiting passage of an unauthorized tubular structure.

Another embodiment of the invention is directed to a system comprising: a portable electronic device; and a tubular lock comprising an outer portion, an inner portion, and a plurality of movable pins disposed between the outer portion and the inner portion, and being accessible through a space formed by the outer portion and the inner portion, and at least one fixed structure inhibiting passage of an unauthorized tubular structure to the movable pins, wherein the tubular lock is secured to the portable electronic device.

Another embodiment of the invention is directed to a method for using a tubular lock comprising: obtaining a tubular lock, wherein the tubular lock comprises an outer portion, an inner portion, and a plurality of movable pins disposed between the outer portion and the inner portion, and being accessible through a space formed by the outer portion and the inner portion, and at least one fixed structure inhibiting passage of an unauthorized tubular structure to the movable pins; and attaching the tubular lock to a portable electronic device.

These and other embodiments of the invention will be described in further detail below.

DETAILED DESCRIPTION

Axial pin tubular locks are conventionally based upon a design including a tubular sleeve within which a locking spindle is rotatably mounted and a driver spindle is rigidly anchored within the tubular sleeve. The locking spindle is normally prevented from rotation by axially movable small pins. The pins are divided up in pairs. Each pair rests in a shaft running through the locking spindle and driver spindle. Springs in the driver spindle keep the pins in position. When no key is inserted, the driver pin in each pair is halfway in the driver spindle and halfway in the locking spindle. The position of the driver pins keeps the locking spindle from turning. The combinating pins in the locking spindle are usually of different lengths and, when actuated by using a proper key, axially displace the driver pins through different predetermined distances, such that all the pins are precisely aligned at the shear plane between the locking spindle and the driver spindle. This permits the locking spindle to turn and bring about the unlocking action.

Figure 1:
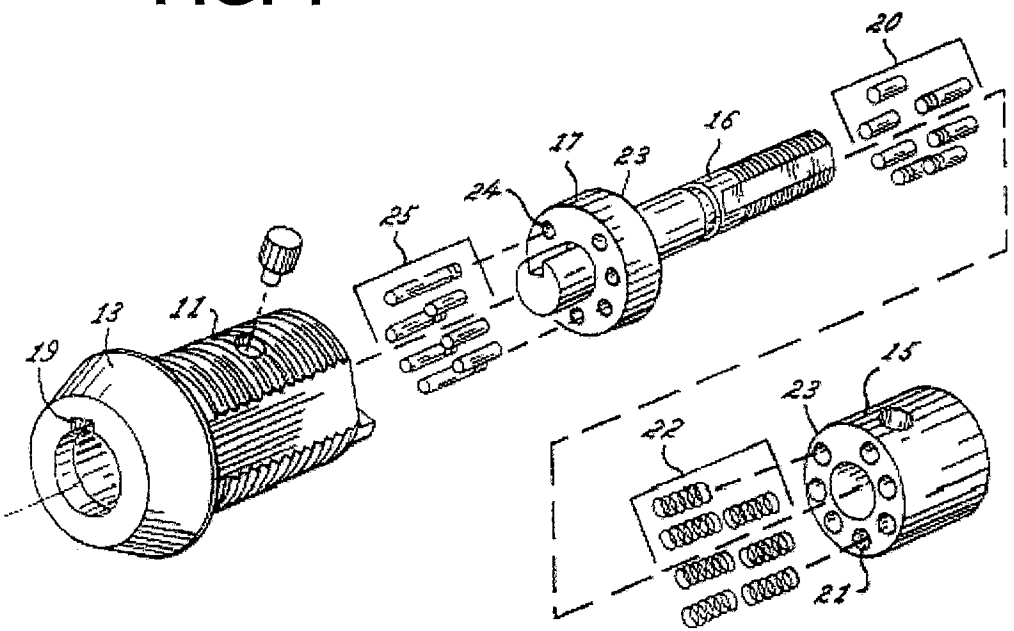
FIG. 1 Prior Art
FIG. 1 shows an exploded view of a tubular lock.
Figure 2:
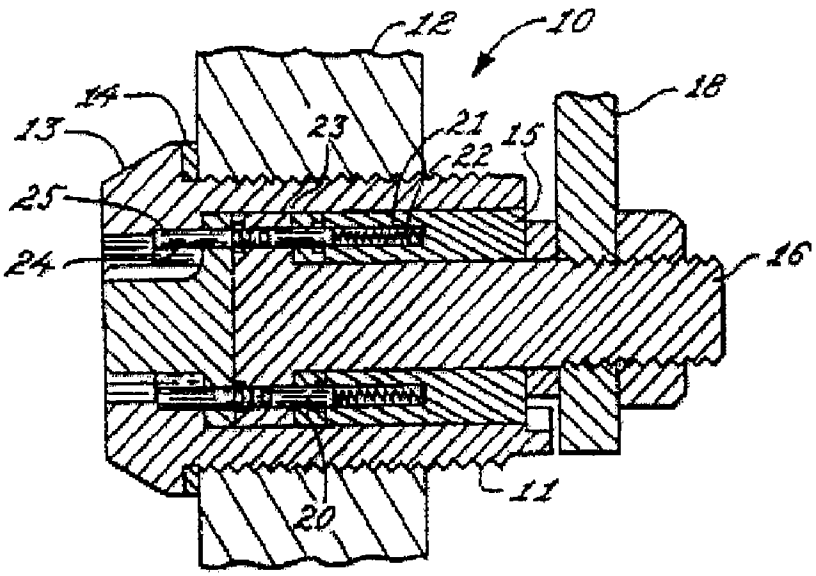
FIG. 2 Prior Art
FIG. 2 shows a cross-sectional view of a tubular lock.

FIGS. 1 and 2 show a tubular tumbler lock 10. The tumbler lock 10 includes an outer tubular body 11 which is adapted to be threaded into a support member 12 and includes a frustoconical head 13, which may constitute an outer portion. A washer 14 is interspersed between the member 12 and the lock head 13 and functions to mount the lock assembly rigidly onto the mounting surface of a structure 12. A stationary driver spindle 15 telescopes into and is rigidly anchored within the rear end of the tubular body 11. A locking spindle 16 is rotatably supported in the driver spindle 15 and extends through the lock body. A pin sleeve 17 is located at the forward end of the rotating spindle 16 and a locking member 18 is fastened into position after being inserted through the cross-section of the rear end of the spindle 16.

Actual locking and unlocking action of the lock is brought about by the rotating motion of the locking spindle which in turn causes the locking member 18 to move between a locked and unlocked position. Rotational movement of the spindle 16 is normally effected by using an authorized tubular structure such as a key end that is (not shown) adapted to fit into the frutsoconical head 13 over the spindle and having a tab which aligns with a keyway 19 provided on the head of the lock.

A series of angularly spaced driver pins 20 are slidably positioned within bores 21 defined through the driver spindle 15 and function to normally retain the locking spindle 16 in its locked position wherein rotational motion is prohibited. The driver pins 20 are invariably urged forward by means of coiled compression springs 22 disposed within the bores 21 which retain the pins. Under the urging of the springs 22, the driver pins 20 are disposed along the bores 21 in such a manner that the outer ends of the pins normally project outward beyond the shear plane 23 formed at the interface of the driver spindle 15 and the pin sleeve 17 and into corresponding bores 24 defined through the pin sleeve. In this normal position, the driver pins lock the pin sleeve 17 and the spindle 16 against rotational motion relative to spindle 15.

However, such rotational motion is permitted if the driver pins are displaced rearwardly against the urging of the compression springs so that the forward ends of the driver pins lie exactly at the shear plane 23. This rearward displacement of the driver pins is effected by pins 25 positioned in an axially slidable manner within the bores 24 of the pin sleeve in such a way that the ends of the pins engage with the ends of the corresponding driver pins. Generally, at least some of the driver pins are of different lengths so that alignment of all pins at the shear plane necessarily requires the displacement of different driver pins by different predetermined distances. This requires the use of a properly coded key to displace the driver pins through the predetermined distances in order to cause the rear ends of all of the combinating pins to be simultaneously aligned at the shear plane so that the spindle may be rotated. Further details regarding the lock shown in FIGS. 1 and 2 can be found in U.S. Pat. No. 4,716,749, which is herein incorporated by reference in its entirety.

Figure 3:
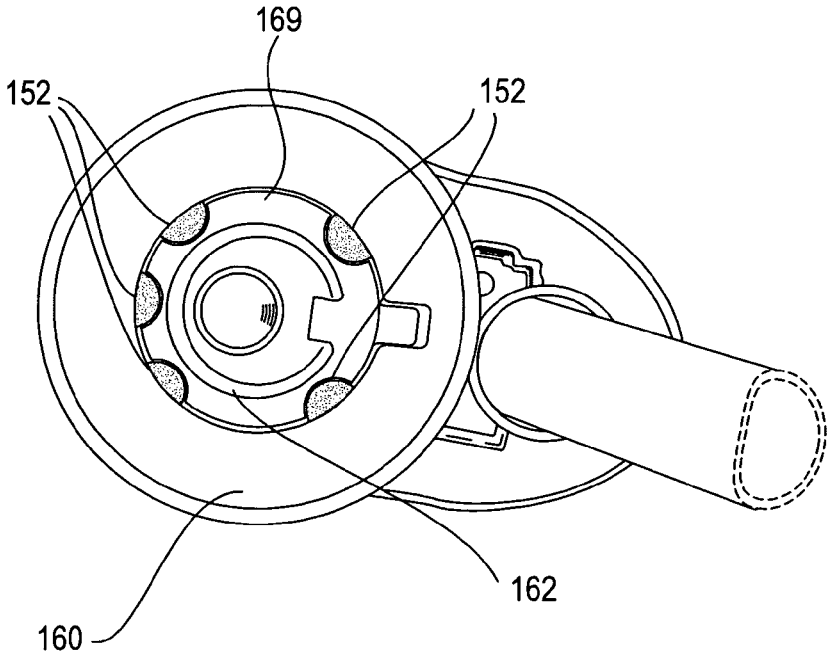
FIG. 3 shows a view of a key end of a tubular lock.

FIG. 3 shows a close-up view of a key end of a conventional lock. The lock shown in FIG. 3 is different than the lock shown in FIGS. 1 and 2. However, the lock end shown in FIG. 3 could be used with the general lock mechanisms shown in FIGS. 1 and 2. The lock includes an outer portion 160 that surrounds an inner portion 162. The region between the outer portion 160 and the inner portion 162 may define a space 169. As shown, the space 169 is circular in shape.

Combinating, movable pins 152 are visible in the space 169 defined by an outer portion 160 and an inner portion 162. The combinating pins 152 are engaged by a key (not shown) with a circular end and the key has cutouts that will drive the combinating pins 152 predetermined distances in axial directions (as explained above).

As noted in the news reports described in the background section above, if an unauthorized plastic cylinder such as the barrel of a pen has appropriate dimensions and is inserted into the space 169, the barrel of the pen may potentially be used to unlock the lock. It would be desirable to provide for a lock solution that would impede the passage of an unauthorized tubular structure, but could permit the passage of an authorized tubular structure.

Figure 4:
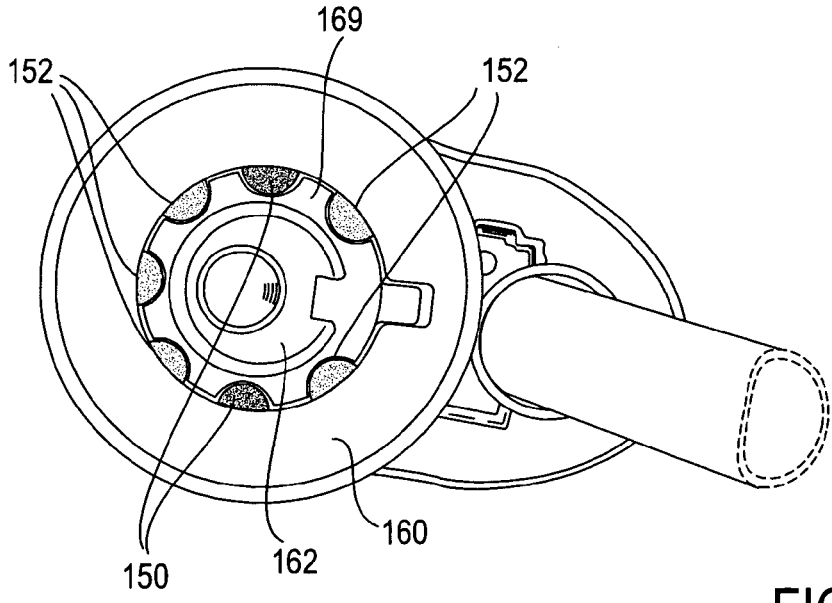
FIG. 4 shows a view of a key end of a tubular lock, where stationary pins are in the tubular lock.

FIG. 4 shows a close-up view of a key end of a lock according to an embodiment of the invention. In FIG. 4, the reference numbers refer to the same elements shown in FIG. 3. Five pins 152 are movable after a user inserts a circular key into the space between the outer portion 160 and the inner portion 162. However, two pins 150 are not movable and are "fixed". The fixed and movable pins, and the inner and outer portions of the lock may be made of the same or different material. For example, any of these components may be made of a hard material such as stainless steel. The authorized key that is used with the lock would have cutouts that would allow the key end to pass by the fixed pins 150.

Since the pins 150 are fixed and not movable, it is quite difficult to insert an unauthorized tubular structure such as the plastic barrel of a pen or other structure within the space 169, thereby inhibiting lock picking with the unauthorized tubular structure. A thief that tries to use a barrel of a plastic ball point pen to pick the lock will find that it is extremely difficult to jam the barrel into the space 169 between the inner portion 162 and the outer portion 160, because the pins 150 are "fixed". The fixed pins 150 impede the passage of the barrel towards the movable pins 152. Thus, the fixed pins 150 act as a physical barrier to an unauthorized plastic pen barrel, but will not impede the passage of a preformed key end.

Although two stationary, non-movable pins 150 are shown, it is understood that any number of non-movable stationary pins can be used in other embodiments of the invention. For example, there can be only one non-movable pin in between the inner portion 162 and the outer portion 160 in some embodiments. In other embodiments, there can be three or more fixed pins 150 between the inner portion 162 and the outer portion 160. Preferably, the fixed pins (or other fixed structures) are evenly spaced in the space 169 (e.g., a 12 and 6 o'clock positions; at 12, 3, 6, and 9 o'clock positions, etc.) so that an unauthorized pen barrel has a more difficult time pushing the movable pins 152 inwardly to thereby form an impression of the lock's key.

Other suitable fixed structures could be used in other embodiments of the invention. For example, instead of or in addition to fixed, non-movable pins, the fixed structures could be in the form of small rectangular blocks, which extend from the outer portion 160 or the inner portion 162. They could also extend from the outer portion 160 and the inner portion 162 in an alternating manner around the circular space 169. In yet another embodiment, the at least one fixed structure could be one or more "bridges" that bridge the space 169 in radial directions. In yet another embodiment, the at least one fixed structure could include a flange or other structure that could partially cover the space 169, so that the at least one fixed structure need not be directly between the inner portion 162 and the outer portion 160. In yet another embodiment, the fixed, non-movable structure could be an extension of the inner and/or outer portions of the lock. Such extensions could make the space 169 narrower at certain radial positions, thus impeding the passage of the end of a plastic barrel of a pen into the space 169. Any of these fixed, non-movable structures would make it very difficult for one to insert an unauthorized tubular lock picking structure into the space 169. Accordingly, embodiments of the invention provide a useful deterrent to lock picking.

Figure 5:
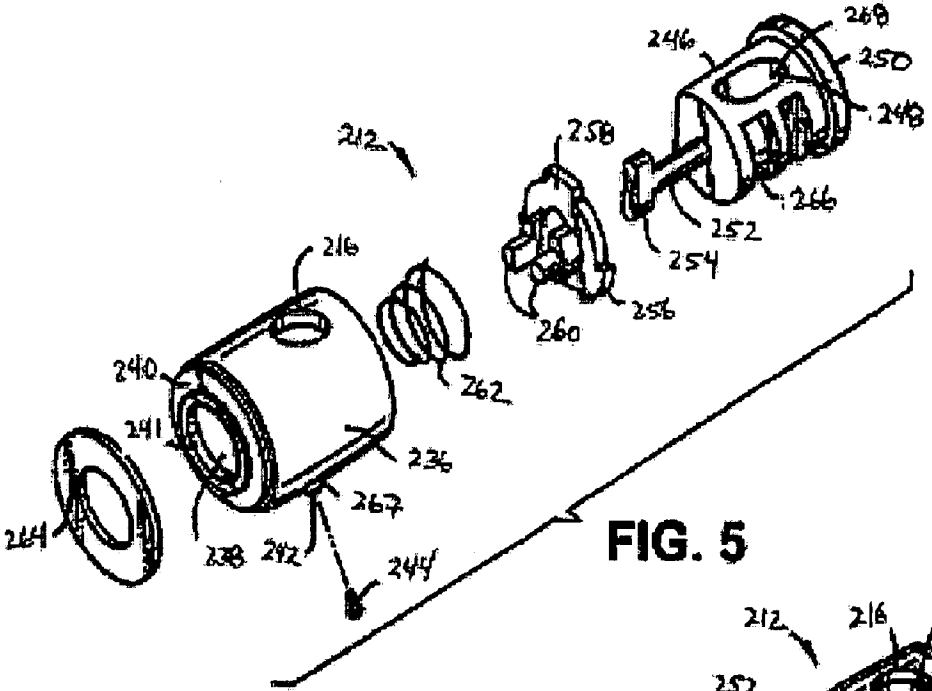
FIG. 5 shows an external perspective view of a lock including a locking end with a T-bar and pins.
Figure 6:
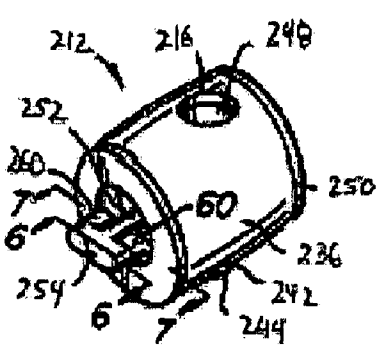
FIG. 6 shows a locking end with a T-bar and pins

FIGS. 5 and 6 show exploded and assembled perspective views of a lock 212 that can incorporate the fixed structures and locking mechanisms described above. The lock 212 includes a lock end having a movable locking structure 254 in the form of a T-bar, and one or more insertable structures 260 in the form of pins. Lock 212 includes a housing 236 having a hollow interior cylindrical cavity 238. An annular plate 240 forms one end of housing 236 and has an aperture 241. A pair of apertures such as aperture 216 are located on opposite sides of housing 236. A small raised aperture 242 is also provided in housing 236 to accommodate a pin 244.

A spindle 246 includes a cylindrical portion 248 adapted to fit within the cylindrical cavity of housing 236. Spindle 246 includes a raised plate 250 at one end. Spindle 246 also includes a shaft 252 extending outwardly through the aperture 241 in housing 236. A locking structure in the form of a crossmember 254 is located on the distal end of shaft 252. The spindle 252 may house any of the lock components (e.g., the stationary pins) shown in and described with respect to FIGS. 1, 2, and 4. The movement of the crossmember 254 may be analogous to the movable member 218 shown in FIG. 2.

An abutment mechanism 256 includes an abutment plate 258 designed to be received within the cylindrical interior cavity of housing 236, and a pair of insertable structures in the form of pins 260 adapted to extend outwardly through the aperture 241 in housing 236. A spring 262 biases abutment plate 258 and spindle 246 rearwardly when the lock is assembled. A plastic bushing 264 designed to prevent scarring of the equipment to which lock 212 is attached is affixed to the plate 240 on housing 236 circumscribing aperture 241.

When lock 212 is assembled as illustrated in FIG. 6, the crossmember 254 and shaft 252, together with pins 260 on either side of the shaft, extend outwardly beyond housing 246 through aperture 241. Pin 244 engages a groove 266 in spindle 246 so that the mechanism cannot be disassembled without removing the pin. The head of pin 244 is conformed to the shape of a boss 267 on the surface of housing 236 so that the pin cannot be removed without special equipment. Groove 266 has a preselected width allowing limited axial movement of spindle 246 relative to housing 236 with pin 244 engaged so that the axial position of crossmember 254 relative to the housing is somewhat adjustable. Spring 262 biases plate 258 and spindle 246 rearwardly to bias crossmember 254.

In this example, groove 266 extends around about 25% of the periphery of spindle 246 so that the spindle can be rotated approximately 90 degrees relative to the housing. A transverse aperture 268 through the cylindrical portion 248 of spindle 246 is aligned with aperture 216 in housing 236 when crossmember 254 is misaligned from pin 260 (see FIG. 7). With spindle 246 rotated 90 degrees as allowed by pin 244 in groove 268, crossmember 254 is aligned with pin 260, and aperture 268 is not aligned with aperture 216. A cable (not shown) can only be inserted through the aligned apertures 216, 268 when crossmember 254 is misaligned with pins 260, i.e., when attachment mechanism 212 is attached to the piece of equipment, as explained hereinbelow. With the cable passing through aligned apertures 216 and 268, rotation of spindle 246 so as to align crossmember 254 with pins 260 and allow removal of the attachment mechanism is effectively prevented. As an alternative to using the aligned apertures 216, 268, a cable (not shown) could simply be attached to the housing 236 as shown in FIG. 8.

Other elements are described in detail in U.S. Pat. No. 5,502,989, which is herein incorporated by reference in its entirety for all purposes. Other lock end structures are shown in U.S. Pat. Nos. 6,553,794 and 6,006,557, which are herein incorporated by reference in their entirety for all purposes. Any such lock end structures can be used in embodiments of the invention.

Figure 7:
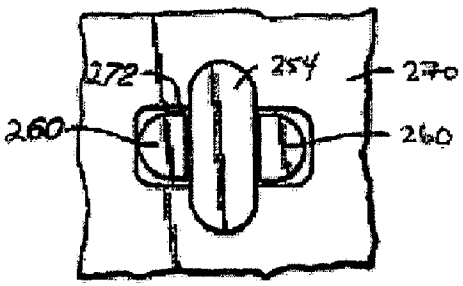
FIG. 7 shows a locking end with a T-bar and pins, which extend through a security slot in a housing

FIG. 7 shows an external view of a lock with a lock end having a movable locking structure 254 in the form of a T-bar, and one or more insertable structures 260 in the form of pins as they are inserted into a security slot 272 in a housing of a device 270 to be localized. The device may be a portable electronic device such as a portable computer. In preferred embodiments, the dimensions of the security slot 272 may have dimensions from about 7 mm by about 3 mm. The security slot 272 may be rectangular in shape.

Figure 8:
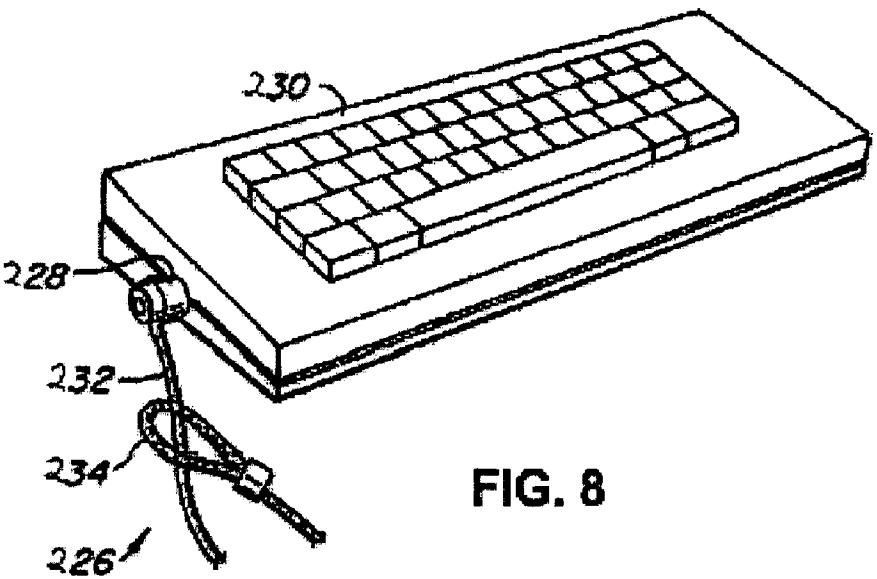
FIG. 8 shows a lock attached to a portable electronic device.

FIG. 8 shows a portable electronic device 230 in the form of a keyboard. A lock according to an embodiment of the invention can be attached to the portable electronic device 230 via a slot in the portable electronic device 230. A cable 232 attached to the lock 228 may include a loop 234 at one end. The lock 228 can be inserted through the loop and the cable 232 can be wrapped around an immovable object (not shown) to secure the portable electronic device 230 to the immovable object. The cable and lock may form, alone or in combination with other elements, a security system.

The locks according to embodiments of the invention are particularly suitable for securing portable electronic devices so that they cannot be stolen. Examples of portable electronic devices include laptop computers, flat panel monitors, TVs, portable hard disk drives, etc. The locks can also be used with other types of non-electronic articles as well. For example, the locks according to embodiments of the invention could be used to secure bicycles as well.

Any recitation of "a", "an" or "the" is intended to mean one or more unless specifically indicated to the contrary.

The terms and expressions which have been employed herein are used as terms of description and not of limitation, and there is no intention in the use of such terms and expressions of excluding equivalents of the features shown and described, or portions thereof, it being recognized that various modifications are possible within the scope of the invention claimed.

Moreover, any one or more features of any embodiment of the invention may be combined with any one or more other features of any other embodiment of the invention, without departing from the scope of the invention.

All patent applications, patents, and publications mentioned above are herein incorporated by reference in their entirety for all purposes. None is admitted to be prior art.

What is claimed is:

1. A tubular lock comprising:

an outer portion;

an inner portion;

and a plurality of movable pins disposed between the outer portion and the inner portion, and being accessible through a space formed by the outer portion and the inner portion; and at least one fixed structure preventing passage of an unauthorized tubular structure into the space, wherein the at least one fixed structure is disposed between the outer portion and the inner portion and is visible from outside the outer portion.

2. The tubular lock of claim 1 wherein the space is circular.

3. The tubular lock of claim 1 wherein the at least one fixed structure includes at least one fixed, non-movable pin.

4. The tubular lock of claim 1 wherein the at least one fixed structure includes at least two fixed, non-movable pins.

5. The tubular lock of claim 1 wherein the at least one fixed structure is a bridge that bridges the space.

6. The tubular lock of claim 1 wherein the at least one fixed structure has a rectangular cross-section.

7. The tubular lock of claim 1 further comprising a locking end, wherein the locking end includes a structure for engaging a security slot in a computer.

8. The tubular lock of claim 1 wherein the lock forms part of a bike lock.

9. The tubular lock of claim 1 further comprising a locking end, wherein the locking end includes a movable locking structure in the form of a T-bar for engaging a computer security slot, and an insertable structure for inserting into the slot before or after the T-bar is engaged with the slot.

10. The tubular lock of claim 1 wherein the fixed structure extends from the outer portion.

11. A system comprising:

a portable electronic device; and a tubular lock comprising an outer portion, an inner portion, and a plurality of movable pins disposed between the outer portion and the inner portion, and being accessible through a space formed by the outer portion and the inner portion, and at least one fixed structure preventing passage of an unauthorized tubular structure to the movable pins, wherein the at least one fixed structure is disposed between the outer portion and the inner portion and is visible from outside the outer portion, and wherein the tubular lock is secured to the portable electronic device.

12. The system of claim 11 further comprising a cable coupled to the tubular lock, and an immovable object, wherein the immovable object and the portable electronic device are secured together with the tubular lock and the cable.

13. The system of claim 11 wherein the portable electronic device comprises a slot in a wall of the portable electronic device and wherein the tubular lock is attached to the portable electronic device via the slot.

14. The system of claim 11 wherein the fixed structure comprises a pin.

15. The system of claim 11 wherein the fixed structure extends only partially between the inner and outer portions.

16. The system of claim 11 wherein the fixed structure extends from the outer portion.

17. A method for using a tubular lock comprising:

obtaining a tubular lock, wherein the tubular lock comprises an outer portion, an inner portion, and a plurality of movable pins disposed between the outer portion and the inner portion, and being accessible through a space formed by the outer portion and the inner portion, and at least one fixed structure preventing passage of an unauthorized tubular structure to the movable pins, wherein the at least one fixed structure is disposed between the outer portion and the inner portion and is visible from outside the outer portion; and attaching the tubular lock to a portable electronic device.

18. The method of claim 17 further comprising:

wrapping a cable attached to the tubular lock around the portable electronic device.

19. The method of claim 17 wherein the portable electronic device is a computer.

20. The method of claim 17 wherein the fixed structure comprises a pin.

21. The method of claim 17 wherein the fixed structure extends only partially between the inner and outer portions.

22. The method of claim 17 wherein the fixed structure does not contact the inner portion.

* * * * *